US006745122B2

(12) United States Patent
Burgdorf et al.

(10) Patent No.: US 6,745,122 B2
(45) Date of Patent: Jun. 1, 2004

(54) METHOD FOR OPERATING AN INTERNAL COMBUSTION ENGINE

(75) Inventors: Jochen Burgdorf, Offenbach (DE); Bernhard Giers, Frankfurt (DE); Peter Volz, Darmstadt (DE)

(73) Assignee: Continental Teves AG & Co., oHG, Frankfurt (DE)

( * ) Notice: Subject to any disclaimer, the term of this patent is extended or adjusted under 35 U.S.C. 154(b) by 52 days.

(21) Appl. No.: 10/181,013

(22) PCT Filed: Dec. 23, 2000

(86) PCT No.: PCT/EP00/13254

§ 371 (c)(1),
(2), (4) Date: Jul. 12, 2002

(87) PCT Pub. No.: WO01/51775

PCT Pub. Date: Jul. 19, 2001

(65) Prior Publication Data

US 2003/0000488 A1 Jan. 2, 2003

(30) Foreign Application Priority Data

Jan. 14, 2000 (DE) ..... 100 01 196
Sep. 29, 2000 (DE) ..... 100 48 263

(51) Int. Cl.[7] ..... F02D 13/02
(52) U.S. Cl. ..... 701/115; 123/90.12; 123/90.16
(58) Field of Search ..... 701/115, 102, 701/101; 123/90.11, 90.12, 90.15, 90.17

(56) References Cited

U.S. PATENT DOCUMENTS

| | | | | |
|---|---|---|---|---|
| 4,972,810 A | * | 11/1990 | Kawamura | 123/90.11 |
| 4,995,351 A | * | 2/1991 | Ohkubo et al. | 123/90.11 |
| 5,050,543 A | * | 9/1991 | Kawamura | 123/90.11 |
| 5,377,654 A | | 1/1995 | LoRusso et al. | 123/673 |
| 5,419,301 A | | 5/1995 | Schechter | 123/90.13 |
| 5,850,811 A | * | 12/1998 | Tomisawa et al. | 123/90.15 |
| 5,868,108 A | | 2/1999 | Schmitz et al. | 123/90.11 |
| 6,295,970 B1 | * | 10/2001 | Kawakami | 123/406.47 |
| 6,637,391 B2 | * | 10/2003 | Muraki et al. | 123/90.17 |

FOREIGN PATENT DOCUMENTS

| | | | |
|---|---|---|---|
| DE | 195 34 878 | 3/1997 | |
| JP | 9-317503 | * 12/1997 | F01L/1/34 |

* cited by examiner

*Primary Examiner*—Hieu T. Vo
(74) *Attorney, Agent, or Firm*—Rader, Fishman & Grauer PLLC

(57) ABSTRACT

A method for operating a multi-cylinder internal combustion engine having gas exchange valves which are variably adjustable with respect to the valve opening characteristics either directly electromagnetically or by way of an electro-hydraulic valve actuation system which includes several electromagnetic valves. For adaptation of all gas exchange valves to a desired valve opening characteristics, the electromagnetic valves are operated cylinder-selectively in the operation of the internal combustion engine by means of variable actuating voltages and/or actuating currents.

2 Claims, 3 Drawing Sheets

METHOD FOR OPERATING AN INTERNAL COMBUSTION ENGINE

The present invention relates to a method for operating an internal combustion engine according to the preamble of patent claim 1.

In the journal 'Auto Motor und Sport', volume 17, 1999, page 49, an electrohydraulic valve actuation system for an internal combustion engine has already been described which includes a tappet actuated by a camshaft that does not act directly on a gas exchange valve. (inlet valve) in the cylinder head of the internal combustion engine but by means of hydraulic oil (motor oil). The pressure of the hydraulic fluid propagates by way of a brake piston to the gas exchange valve, and this quantity of hydraulic oil and, thus, also the stroke of the gas exchange valve in the cylinder head can be varied in response to the valve's switch position of an electromagnetic valve integrated in the cylinder head. Variations of the valve opening times cannot be ruled out due to manufacturing tolerances for the above-mentioned components so that unequal cylinder fills will automatically lead also to a spreading of the exhaust emissions, especially with respect to the multi-cylinder construction of the internal combustion engine.

In view of the above, an object of the present invention is to develop a method for operating a multi-cylinder internal combustion engine which permits adapting the cylinder fills of all engine cylinders so that the above-mentioned shortcomings are avoided.

According to the present invention, this object is achieved by a method with the features of patent claim 1.

Further features, advantages and possible applications of the present invention can be taken hereinbelow from the description of an embodiment explained with reference to several accompanying drawings.

Figure 1:
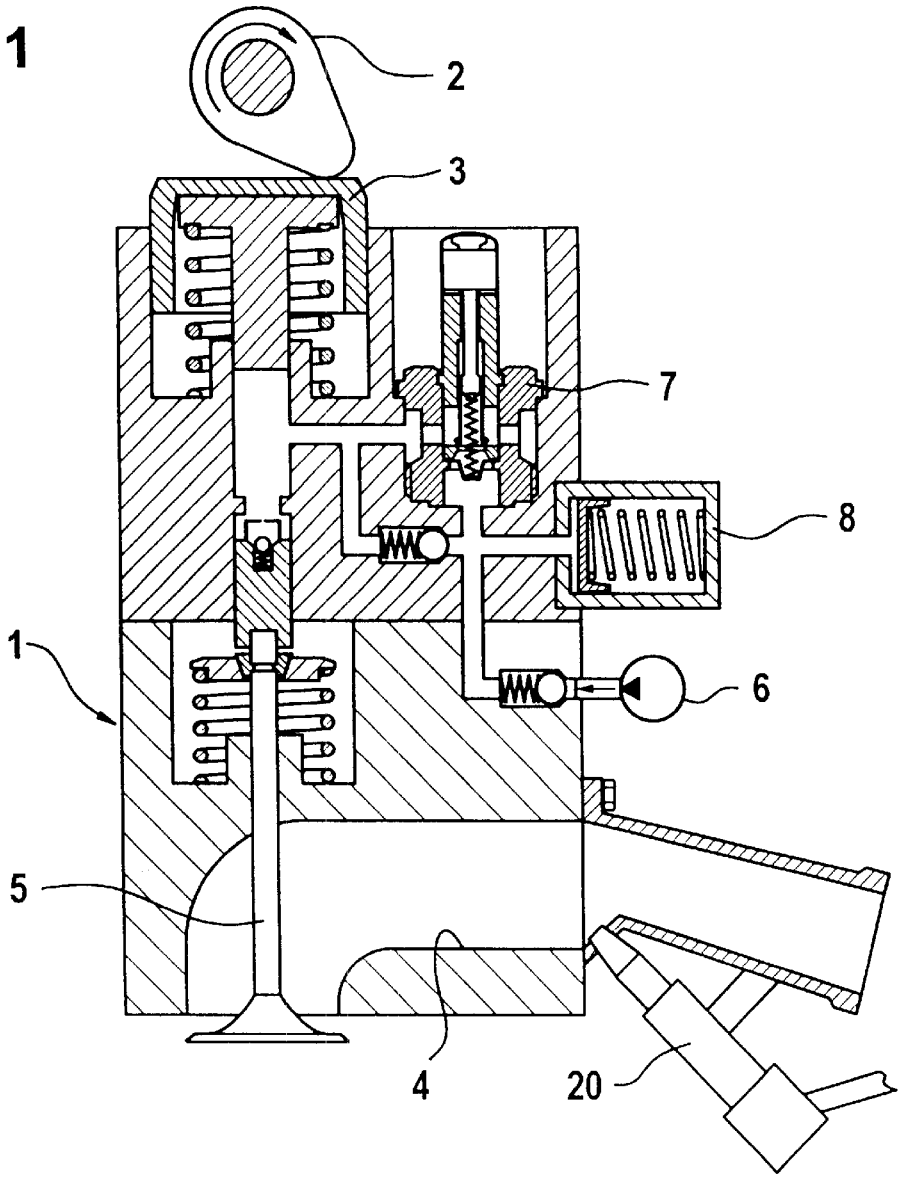
FIG. 1 is a diagrammatic sketch of an electrohydraulic valve actuation system.

FIG. 1 discloses a diagrammatic sketch of an electrohydraulic valve actuation system, including a valve drive unit that is arranged in the cylinder head 1 of an internal combustion engine, comprised of a camshaft 2, a tappet assembly 3, and a gas exchange valve 5 which, in the capacity of an inlet valve, extends into the intake port 4 of the internal combustion engine. The gas exchange valve 5 is not actuated directly by the tappet assembly 3, but is actuated by means of a pressure fluid volume provided by the engine oil pump 6 so as to be variable with respect to the sequence of motions. To this end, an electromagnetic valve 7 is inserted into the cylinder head 1 in order to vary the pressure fluid volume compressed between the tappet assembly 3 and the gas exchange valve 5. Because the internal combustion engine includes several cylinders, there is also multiple provision of the initially mentioned other components of the electrohydraulic valve actuation system corresponding to the number of the gas exchange valves.

Besides, the valve actuation system includes per engine cylinder one intermediate storage 8 that takes up superfluous pressure fluid volume, if any, which is not required for the control of the valve actuation, system. In addition, an injection valve 20 is mounted in the intake port 4 which, exactly as the electromagnetic valve 7, can be operated by means of a variable actuating voltage and/or a variable actuating current to adjust all engine cylinders to uniform rates of injection.

The diagrammatic sketch of the electrohydraulic valve actuation system according to the drawings is consequently rated for a multi-cylinder and, thus, multi-valve internal combustion engine in terms of control technology, with the objective of influencing the valve stroke electrohydraulically for each engine cylinder. Only a few milliseconds are available to actuate the electromagnetic valves 7 at high engine speeds.

A suitable method of operation of the internal combustion engine prevents the system tolerances in the actuation control, the magnetic circuit and the component tolerances within the valve drive unit from causing an unacceptable spreading of the valve opening cross-sections because now the hydraulic control pressure between the tappet assembly 3 and the associated gas exchange valve 5, according to the present invention, is adjusted individually for each engine cylinder by controlling the valve actuating voltage applied to the electromagnetic valve 7 or the valve current so that equal valve strokes for all gas exchange valves 5 result per combustion cycle. Theoretically, this would be technically possible also with the aid of travel sensors in the area of the gas exchange valves. However, this solution is not feasible due to cost and structural reasons. Also, care should be taken that the exhaust emission is usually adjusted by means of one single lambda probe per cylinder row.

Figure 2:
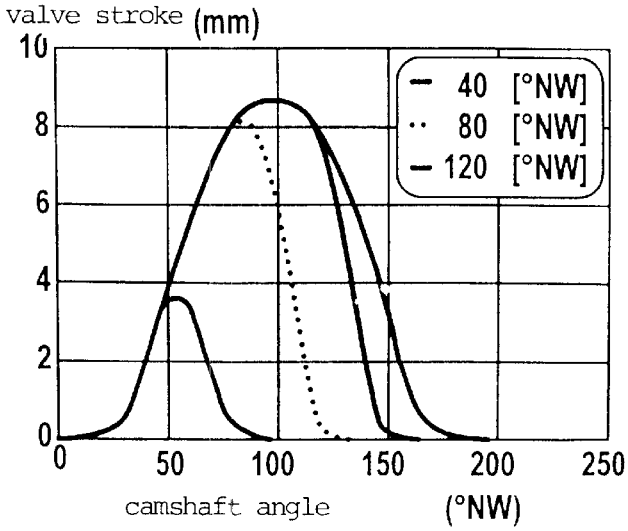
FIG. 2 is a view of the variable valve adjustment of the gas exchange valves resulting from the valve actuation system of FIG. 1, illustrated by several valve stroke curves.

FIG. 2 shows exemplarily the valve stroke curves which are principally adjustable by the preset variable valve actuation system according to FIG. 1. Starting from a maximum camshaft angle illustrated on the abscissa, the valve stroke curves are also plotted for reduced valve opening clearances of 40 degrees, 80 degrees, and 120 degrees camshaft angles. Along the ordinate, the valve stroke possible for each camshaft angle is plotted which, automatically, exhibits the smallest valve stroke of roughly 3.8 mm with regard to the smallest camshaft angle of 40 degrees.

Figure 3:
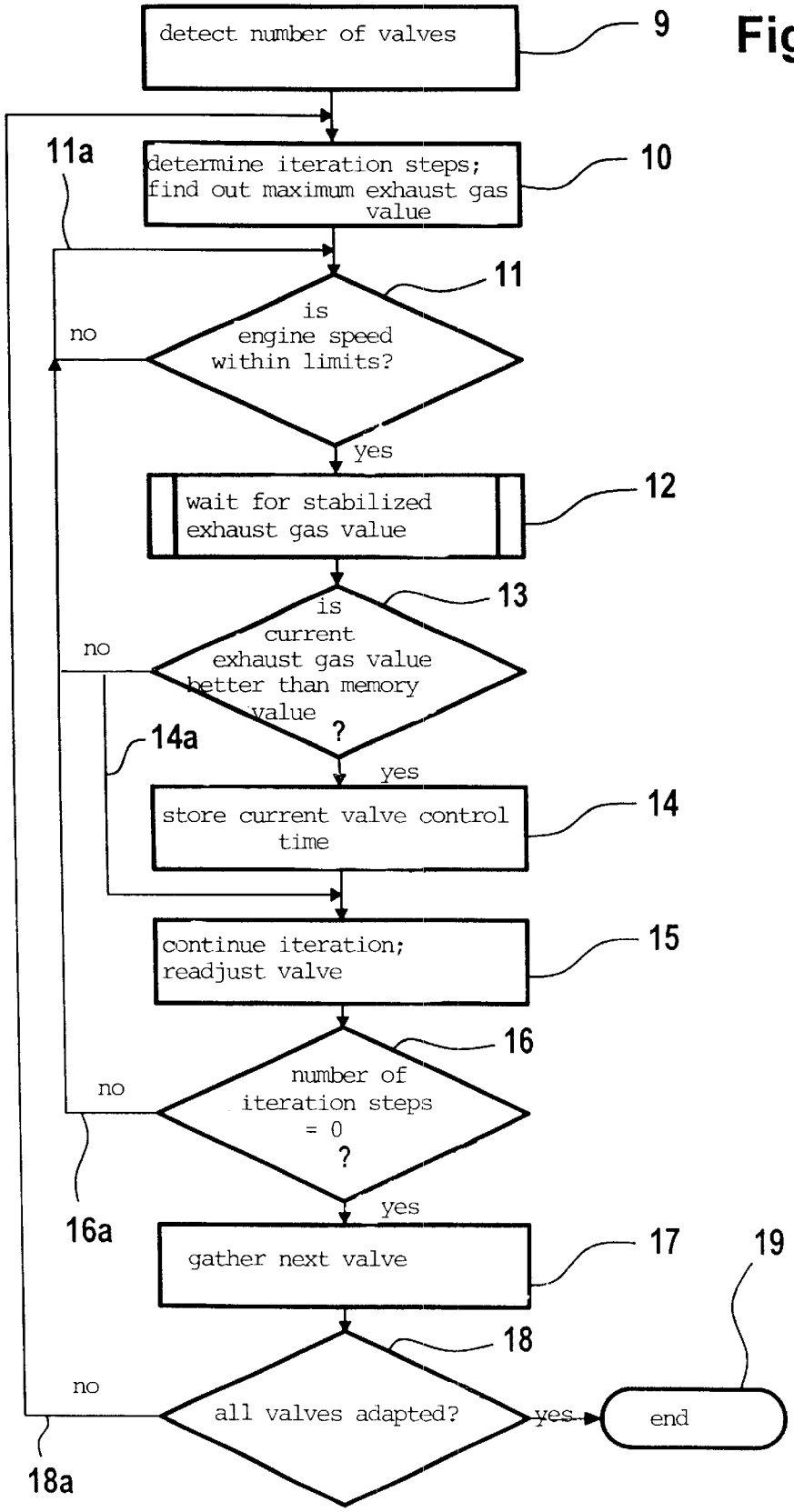
FIG. 3 is an explanation of individual process steps by way of a program flow chart which permit rendering uniform or synchronizing the valve control times of all engine cylinders in consideration of minimum exhaust gas values.

According to the present invention, FIG. 3 shows the individual process steps for rendering the valve strokes more uniform and, thus, the valve opening times for all gas exchange valves 5 of a multi-cylinder internal combustion engine which is preferably equipped with the electrohydraulic valve actuation system known from FIG. 1. In consideration of the program run according to FIG. 3, the above-mentioned system-induced imponderabilities and tolerances in the actuation control of the electromagnetic valves 7 and in the valve drive unit may be adjusted so that each valve actuation system is selectively tuned to an optimum, exhaust emission, with the internal combustion engine running, and the actuation parameters for the electromagnetic valves 7 acquired are stored in a data memory. To this end, the internal combustion engine is favorably operated in the rotational speed band in which inadmissible deviations of the exhaust emission of the individual engine cylinders are the result. The exhaust emission is sensed in a per se known manner by means of a lambda control circuit. The actuating voltage or actuating currents of each single electromagnetic valve 7 is then varied according to the program flow chart and stored in the data memory in a cylinder-selective manner, and gathered in the way of parameters as a function of the engine rotational speed. Based on the performance graph of parameters fixed from cylinder to cylinder, the entire actuation control of the electromagnetic valves 7 takes place.

The method for determining the exactly synchronized valve control times will now be explained in detail by way of the program flow chart according to FIG. 3.

Whenever the internal combustion engine is operated, the electromagnetic valves 7 of all engine cylinders are initialized according to a first operation step 9 specifically for adapting the gas exchange valves 5 with respect to each other. In a second operation step 10, the worst exhaust gas value is initiated, and the number of the iteration steps and the iteration step width is determined. In a third operation step according to block 11, it is found out whether the engine speed is within a predetermined rotational speed band. When this condition is not satisfied, a new polling of the engine speed out of the engine control device is made by means of loop 11*a*. Only if the internal combustion engine is in the predetermined rotational speed band, which is especially critical in terms of exhaust gas and where a process of adjustment of the electromagnetic valves 7 shall be carried out, will the exit to a subroutine according to operation step 12 follow. In said step 12, a currently valid and stabilized exhaust gas value is read into a data memory of the engine control device, what can e.g. be done by way of linking to a lambda control circuit of the engine management. Subsequently, it is checked in the following block 13 whether the current exhaust gas value is better than the previously stored exhaust gas value. When this request is satisfied, the current actuation value for the electromagnetic valve 7 being activated is stored in the next step 14 as a function of the engine speed and the associated engine cylinder. If, however, the request for an improved exhaust gas value is not satisfied after step 13, the iteration method and, hence, the valve adjustment for the currently concerned engine cylinder is continued by way of loop 14*a* instead of step 14. It is checked in operation step 16 whether all iteration steps have been processed. Unless all iteration steps have been processed, the valve adjustment process will be repeated starting from block 2 by way of loop 16*a*. If, however, all iteration steps have been completed, the next electromagnetic valve 7 will be picked up according to field 17. It is checked in step 18 whether the electromagnetic valves 7 of all engine cylinders are adapted. In the negative, the sequence diagram is then repeated commencing operation step 10 by way of loop 18*a*. If, however, the adaptation of all engine cylinders is completed, the valve adaptation method explained is terminated with step 19.

When this valve adaptation process for the individual engine cylinders is gathered by an appropriate algorithm, the offset of the valve control times in relation to a nominal specification, i.e., determining only crankshaft angles of rotations, may be determined in a comparatively simple manner in order to adjust the optimizing parameter 'exhaust gas quality' in this case.

In an extension of the basic idea, values for different rotational speed ranges can be determined and stored in a data memory of the engine management or engine control device. A performance graph or a set of parameters for a mathematically description may be found out thereby.

The algorithm can be used in a test run to determine the parameters. In addition, the algorithm may also be used in the normal operating mode of the internal combustion engine in order to optimize the parameters, e.g. to counteract the aging of components. To this end, it would be necessary to modify the operation step 2 according to FIG. 3 and to indicate the engine speed as an index in the performance graph.

To sum up, a method for operating an internal combustion engine is shown which permits optimizing the exhaust gas values by variation of the actuation times of the electromagnetic valves 7 and, hence, the synchronous actuation of the gas exchange valves 5 (inlet valves). This is done by varying the actuation parameters of the electromagnetic valves 7 in a search operation described in FIG. 3. The result is an optimal valve actuation control for a quality criterion or also for several quality criteria.

Figure 4:
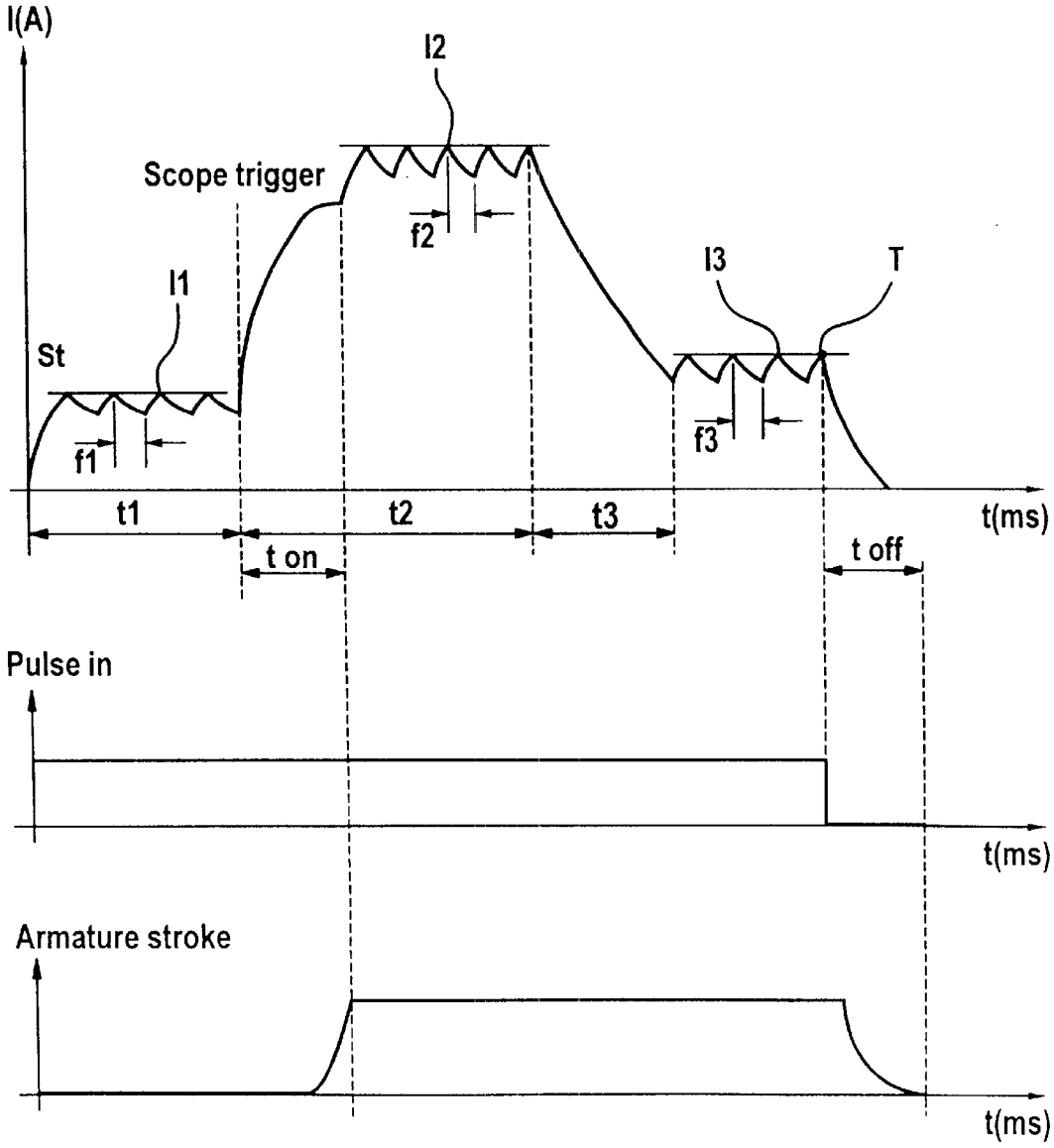
FIG. 4 is a current curve, voltage pulse curve and stroke characteristic curve, representative of the program flow chart of FIG. 3, for one of the electromagnetic valves of the valve actuation or injection system.

With regard to the program flow chart according to FIG. 3, an optimized current characteristic curve for each engine cylinder will result according to FIG. 4 for the electromagnetic valve 7 being respectively activated, wherein the optimal current variation is determined as a function of time and, hence, proportionally to the engine crank angle as well as by the trigger point T. The result of the,adaptation process according to the present invention is a saw-tooth current variation characteristic curve which commences with a comparatively low dead current I1 (starting current), which along with the rise to the exciting current I2 simultaneously causes movement of the magnet armature of the electromagnetic valve 7 and keeps it in the open position until the trigger point T is reached due to the decrease of the exciting current I2 to the holding current I3 which, in its amount, is slightly higher than the dead current I1, with the result that the magnet armature of the electromagnetic valve 7 moves to resume its original inactive position. Due to the method illustrated in FIG. 3, the trigger point T is gathered in a data memory of the engine control device for each electromagnetic valve 7 and, thus, for each gas exchange valve 5 in the engine cylinder. The time variation of the current pulse and the movements of the magnet armature are phase-identically plotted below the current characteristic curve, whereby a direct allocation of the current pulse duration and the magnet armature movement to the current characteristic curve is rendered possible.

To sum up, a valve actuation method is achieved wherein the exhaust emission is measured for each engine cylinder, and wherein subsequently—with the objective of reaching optimized exhaust gas values—the actuating voltage or the actuating current is alternatingly varied as a function of the engine crank angle for each electromagnetic valve 7, and the optimal trigger point T is determined. The optimal switch points of the electromagnetic valves 7 determined during the process are thus acquired individually for each engine cylinder and memorized as a field of parameters in the data memory of the engine control device as a function of the engine speed. Based on this fixed field of parameters, a cylinder-selective valve actuation control will thus be effected which, in the present example, finally leads to equal valve strokes of the gas exchange valves 5.

It is, however, not absolutely necessary that the valve strokes of the electromagnetic valves 7 are equal. Instead, they may be varied in conformity to any requirement and request with a view to achieving the objective. According to the above valve control method, the tolerances of the rate of injection can also be adjusted by a cylinder-selective actuation of the injection valves 20.

The present invention is not restricted to the constructive embodiment of FIG. 1 but also appropriate for alternative valve drive constructions which, for example, arrange for a direct electromagnetic actuation of the gas exchange valves and either include manifold injection or direct injection.

List of Reference Numerals:

1 cylinder head
2 cam shaft
3 tappet assembly

4 intake port
5 gas exchange valve
6 engine oil pump
7 electromagnetic valve
8 intermediate storage
9–19 operation steps
20 injection valve

What is claimed is:

1. Method for operating a multi-cylinder internal combustion engine having gas exchange valves which are variably adjustable with respect to an opening characteristic of the gas exchange valves by way of a direct electromagnet or by way of an electrohydraulic valve actuation system which includes several electromagnetic valves, wherein the electromagnetic valves for adaptation of all gas exchange valves to a desired valve opening characteristics are operated cylinder-selectively in the operation of the internal combustion engine by way of variable actuating voltages or actuating currents, wherein the adaptation of the valve opening characteristics of all gas exchange valves is preferably effected in a data memory of an engine control device, comprising the steps of:

a) initializing the number of the electromagnetic valves or injection valves of all engine cylinders, b) initializing an the exhaust gas value with the highest degree of emission and defining a number of iteration steps and an iteration step width, c) checking whether a predetermined engine speed is maintained where an inadmissible cylinder-selective spreading of the exhaust gas values is to be expected, d) reading the currently valid and stabilized exhaust gas value into a data memory, e) comparing the current exhaust gas value with the exhaust gas value that was previously stored in a performance graph of the data memory, f) storing the current exhaust gas value in the data memory in dependence on an engine speed, if the current exhaust gas value is better than the original exhaust gas value stored in the performance graph of the data memory, g) continuing iteration steps and adjusting the electromagnetic valves, h) storing one or more actuation parameters of all electromagnetic valves in the data memory.

2. Method as claimed in claim 1, wherein the adaptation of all electromagnetic valves is carried out in dependence on the cylinder-selective exhaust emissions of the internal combustion engine.

* * * * *